US010829257B2

(12) United States Patent
Pamperin et al.

(10) Patent No.: US 10,829,257 B2
(45) Date of Patent: Nov. 10, 2020

(54) METHOD AND SYSTEM FOR WRAPPING TIES IN A FACEMASK MANUFACTURING PROCESS

(71) Applicant: O&M Halyard, Inc., Mechanicsville, VA (US)

(72) Inventors: Mark T. Pamperin, Cumming, GA (US); Joseph P. Weber, Suwanee, GA (US); David L. Harrington, Cumming, GA (US); Eric C. Steindorf, Roswell, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 0 days.

(21) Appl. No.: 16/326,819

(22) PCT Filed: Aug. 16, 2017

(86) PCT No.: PCT/US2017/047053

§ 371 (c)(1),
(2) Date: Feb. 20, 2019

(87) PCT Pub. No.: WO2019/035816

PCT Pub. Date: Feb. 21, 2019

(65) Prior Publication Data

US 2020/0172274 A1 Jun. 4, 2020

(51) Int. Cl.
*B65B 63/04* (2006.01)
*B65B 25/20* (2006.01)
(Continued)

(52) U.S. Cl.
CPC ..... *B65B 63/04* (2013.01); *B65B 25/20* (2013.01); *B65B 35/18* (2013.01); *B65B 35/24* (2013.01);
(Continued)

(58) Field of Classification Search
CPC ..... B65B 25/20; B65B 35/18; B65B 35/24; B65B 35/58; B65B 63/04; B65B 63/045;
(Continued)

(56) References Cited

U.S. PATENT DOCUMENTS 1,957,651 A * 5/1934 Joa ..... A61F 13/15747 223/37
3,998,447 A * 12/1976 Joa ..... A61F 13/15747 493/938
(Continued)

FOREIGN PATENT DOCUMENTS

CH 499446 A * 11/1970 ..... B65G 47/248
CH 499446 A 11/1970
(Continued)

OTHER PUBLICATIONS

International Search Report and Written Opinion for PCT/US2017/047053, dated Jul. 12, 2018, 11 pages.

*Primary Examiner* — Stephen F. Gerrity
(74) *Attorney, Agent, or Firm* — Dority & Manning, P.A.

(57) ABSTRACT

An automated system and method wrap the fastening ties around the body of a continuous stream of facemasks in a facemask production line. The facemasks are oriented such that each facemask has a leading pair of ties and a trailing pair of ties extending from a body in a conveying direction of the production line. The leading pair of ties is drawn below the body as the facemask continues to be conveyed in the conveying and wraps under the body. Subsequently, an impinging force is directed onto the body that is sufficient to cause the body to flip backwards at least once as the facemask continues to be conveyed in the conveying direction, thereby causing the leading and trailing pairs of ties to further wrap around the body.

20 Claims, 5 Drawing Sheets

(51) Int. Cl.

| | |
|---|---|
| ***B65B 35/18*** | (2006.01) |
| ***B65B 35/24*** | (2006.01) |
| ***B65B 35/58*** | (2006.01) |
| ***D06F 89/00*** | (2006.01) |
| ***A41D 13/11*** | (2006.01) |

(52) U.S. Cl.
CPC ..... *B65B 35/58* (2013.01); *D06F 89/00* (2013.01); *A41D 13/11* (2013.01); *A41D 13/1161* (2013.01)

(58) Field of Classification Search
CPC ..... A41D 13/1161; D06F 89/00; D06F 89/02; Y10S 493/938
USPC ..... 53/429, 116, 117; 128/863; 223/37; 493/938
See application file for complete search history.

(56) References Cited

U.S. PATENT DOCUMENTS

| | | | | | |
|---|---|---|---|---|---|
| 4,517,785 | A | | 5/1985 | Masuda | |
| 5,503,515 | A | | 4/1996 | Moorehead | |
| 5,996,861 | A | * | 12/1999 | Propach | D06F 89/02 223/37 |
| 6,158,198 | A | | 12/2000 | Faircloth et al. | |
| 6,241,232 | B1 | * | 6/2001 | Schmitt | B65B 63/04 493/938 |
| 6,305,146 | B1 | | 10/2001 | Gerber | |
| 2006/0137691 | A1 | | 6/2006 | Kleman et al. | |
| 2006/0283454 | A1 | | 12/2006 | Delaney et al. | |
| 2015/0259087 | A1 | | 9/2015 | Schwartz et al. | |

FOREIGN PATENT DOCUMENTS

| | | | | | |
|---|---|---|---|---|---|
| CN | 106938799 | A | | 7/2017 | |
| CN | 106938799 | A | * | 7/2017 | A41D 13/11 |
| DE | 1184728 | B | * | 1/1965 | D06F 89/00 |
| DE | 2441056 | B1 | * | 3/1976 | D06F 89/02 |
| EP | 0 773 177 | A2 | | 5/1997 | |
| EP | 1 464 579 | A2 | | 10/2004 | |
| FR | 2062683 | A5 | * | 6/1971 | B65B 35/58 |
| FR | 2313085 | A2 | | 12/1976 | |
| FR | 2313085 | A2 | * | 12/1976 | A41D 13/1115 |
| FR | 2313269 | A1 | * | 12/1976 | B65B 63/04 |
| FR | 2313269 | A1 | | 12/1976 | |
| GB | 2 271 096 | A | | 4/1994 | |
| GB | 2474725 | A | | 4/2011 | |
| JP | 2006314618 | A | * | 11/2006 | |
| NL | 1020526 | C1 | * | 11/2003 | B65G 47/252 |
| NL | 1020526 | C1 | | 11/2003 | |
| WO | WO 2013/015731 | A1 | | 1/2013 | |

* cited by examiner

*-Prior Art-*

*-Prior Art-*

METHOD AND SYSTEM FOR WRAPPING TIES IN A FACEMASK MANUFACTURING PROCESS

PRIORITY INFORMATION

The present application is the national stage entry of International Patent Application No. PCT/US2017/047053, filed Aug. 16, 2017, the contents of which are incorporated herein by reference thereto.

FAMILY OF RELATED APPLICATIONS

The present application is related by subject matter to the following concurrently filed PCT applications (all of which designate the US):

a. International Application No.: PCT/2017/047051; entitled "Method and System for Wrapping Ties in a Facemask Manufacturing Process".

b. International Application No.: PCT/2017/047054; entitled "Method and System for Wrapping Ties in a Facemask Manufacturing Process".

c. International Application No.: PCT/2017/047055; entitled "Method and System for Wrapping Ties in a Facemask Manufacturing Process".

d. International Application No.: PCT/2017/047057; entitled "Method and System for Wrapping Ties in a Facemask Manufacturing Process".

e. International Application No.: PCT/2017/047058; entitled "Method and System for Wrapping Ties in a Facemask Manufacturing Process".

The above cited applications are incorporated herein by reference for all purposes. Any combination of the features and aspects of the subject matter described in the cited applications may be combined with embodiments of the present application to yield still further embodiments of the present invention.

FIELD OF THE INVENTION

The present invention relates generally to the field of protective facemasks, such as surgical facemasks, and more specifically to a method and system for wrapping the head fastening ties attached to each facemask in the manufacturing line of such facemasks.

BACKGROUND OF THE INVENTION

Various configurations of disposable filtering facemasks or respirators are known and may be referred to by various names, including "facemasks", "respirators", "filtering face respirators", "surgical facemasks", and so forth. For purposes of this disclosure, such devices are referred to herein generically as "facemasks."

The ability to supply aid workers, rescue personnel, and the general populace with protective facemasks during times of natural disasters or other catastrophic events is crucial. For example, in the event of a pandemic, the use of facemasks that offer filtered breathing is a key aspect of the response and recovery to such event. For this reason, governments and other municipalities generally maintain a ready stockpile of the facemasks for immediate emergency use. However, the facemasks have a defined shelf life, and the stockpile must be continuously monitored for expiration and replenishing. This is an extremely expensive undertaking.

Recently, investigation has been initiated into whether or not it would be feasible to mass produce facemasks on an "as needed" basis during pandemics or other disasters instead of relying on stockpiles. For example, in 2013, the Biomedical Advanced Research and Development Authority (BARDA) within the Office of the Assistant Secretary for Preparedness and Response in the U.S.

Department of Health and Human Services estimated that up to 100 million facemasks would be needed during a pandemic situation in the U.S., and proposed research into whether this demand could be met by mass production of from 1.5 to 2 million facemasks per day to avoid stockpiling. This translates to about 1,500 masks/minute. Current facemask production lines are capable of producing only about 100 masks/minute due to technology and equipment restraints, which falls far short of the estimated goal. Accordingly, advancements in the manufacturing and production processes will be needed if the goal of "on demand" facemasks during a pandemic is to become a reality.

Certain configurations of pleated facemasks include head fastening ties bonded to the top and bottom edges of a rectangular body. For example, a conventional surgical facemask may have a 3.75 inch×7 inch pleated rectangular body centered on 32 inch ties bonded along the top and bottom edges (long sides) of the body. In the machine direction of the manufacturing line, these ties define a leading set of ties and a trailing set of ties. Prior to conveying the individual facemasks to a packaging station, it is generally desired to wrap the ties around the body of the facemask. However, the current manual and automated methods for wrapping the ties is relatively slow. For mass production of facemasks at the throughputs mentioned above, it will be necessary to wrap the ties around the facemask body while maintaining the high production speeds of the running line.

The present invention addresses this need and provides a method and related system for high speed wrapping of head fastening ties around the facemask body in a facemask production line.

SUMMARY OF THE INVENTION

Objects and advantages of the invention will be set forth in the following description, or may be obvious from the description, or may be learned through practice of the invention.

In accordance with aspects of the invention, an automated method is provided for wrapping fastening ties around a body of a continuous stream of facemasks in a facemask production line. The method includes conveying the facemasks on any manner of conventional conveyor in the production line at an orientation such that each facemask has a leading pair of ties and a trailing pair of ties extending from a body in a conveying direction of the production line. At or upstream of a wrapping station in the conveying direction of the production line, the leading pair of ties are drawn below the body as the facemask continues to be conveyed in the conveying direction such that the leading pair of ties wraps under the facemask body. Subsequently, an impinging force is directed to the facemask body, the impinging force being sufficient to cause the body to flip backwards at least once as the facemask continues to be conveyed in the conveying direction, thereby causing the leading and trailing pairs of ties to further wrap around the body.

In a particular embodiment, the leading pair of ties is drawn below the body by a suction device disposed below the conveyor. For example, the suction device may be disposed in a gap between a first section of the conveyor and a second section of the conveyor such that the leading ties are drawn below the plane of the conveyor before the body reaches the gap. As the body moves across the gap and onto the second section of the conveyor, the leading ties are drawn out of the suction device and are wrapped/folded under the body.

The impinging force that causes the body to flip as the facemask moves in the conveying direction may be applied a plurality of times to cause multiple flips of the body and multiple wrappings of the leading and trailing pairs of ties around the body, depending on the length of the ties and the desired number of wraps.

In a particular embodiment, the plurality of impinging force applications are carried out at sequentially spaced apart locations at the wrapping station in the conveying direction. In this manner, the individual facemasks are not stopped along the conveying direction to form the multiple wrappings. However, in other embodiments, the plurality of impinging force applications are carried out at the same location at the wrapping station. For example, when the body is flipped backwards the first time, it again approaches the same impinging device and can be flipped one or more times by this same device.

The impinging force may be applied by a mechanically actuated device that hits an underside of the body with sufficient force to cause the body to flip backwards as the facemask continues to be conveyed in the conveying direction. For example, this mechanical device may include a piston driven (e.g. hydraulic, pneumatic, spring driven, and the like) cap or plate member that strikes the underside of the facemask body, or a rotary or eccentric driven member, and the like. The mechanical device may deploy from below the conveying plane through a gap in the conveyor on which the facemasks are conveyed through the wrapping station. It should be appreciated that a number of different suitable mechanical impinging devices within the scope and spirit of the invention may be used for this purpose. Timing of the mechanically actuated device may be controlled by, for example, a sensor disposed to detect the leading edge of the facemask body just before the body reaches the device. Timing may also be preset based on the spacing and conveying speed of the facemasks.

In still other embodiments, the impinging force may be applied by a pneumatic device that directs high pressure air to impact an underside of the body with sufficient force to cause the body to flip backwards as the facemask continues to be conveyed in the conveying direction. For example, the pneumatic device may include a nozzle disposed below the conveying plane in a gap in the conveyor. As the facemask body passed over the gap, a high pressure air burst from the nozzle impinges on the underside of the body and causes the facemask to flip backwards, thereby wrapping the ties around the body.

In addition to improving the dispensing process and enabling easier donning of the facemasks, the individually wrapped masks provides for a more compact dispenser box. When the ties are not individually wrapped, the dispenser box and case need to be significantly larger to accommodate the mass of ties.

The present invention also encompasses various system embodiments for wrapping the fastening ties around the body of a facemask in an automated production line in accordance with the present methods, as described and supported herein.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention covers such modifications and variations as come within the scope of the appended claims and their equivalents.

As mentioned, the present methods and systems relate to wrapping the fastening ties around the body of a facemask in an automated method that supports a high throughput of facemasks in a production line. The upstream and downstream facemask production steps are not limiting aspects of the invention and, thus, will not be explained in great detail herein.

Also, the present disclosure refers to or implies conveyance or transport of certain components of the facemasks through the production line. It should be readily appreciated that any manner and combination of article conveyors (e.g., rotary and linear conveyors), article placers (e.g. vacuum puck placers), and transfer devices are well known in the article conveying industry and can be used for the purposes described herein. It is not necessary for an understanding and appreciation of the present methods to provide a detailed explanation of these well-known devices and system.

Various styles and configurations of facemasks that incorporate pairs of head fastening ties are well known, including flat pleated facemasks and pouch (e.g. "duckbill" facemasks, both of which are described briefly below. The present invention has utility in the production lines for these conventional masks, as well as any other type of facemask wherein it is beneficial to wrap the head fastening ties around the body of the facemask for subsequent packaging, dispensing, donning, or any other reasons. For illustrative purposes only, aspects of the present method are described herein with reference to a particular type of flat pleated facemask, as illustrated in FIG. 1.

Figure 1:
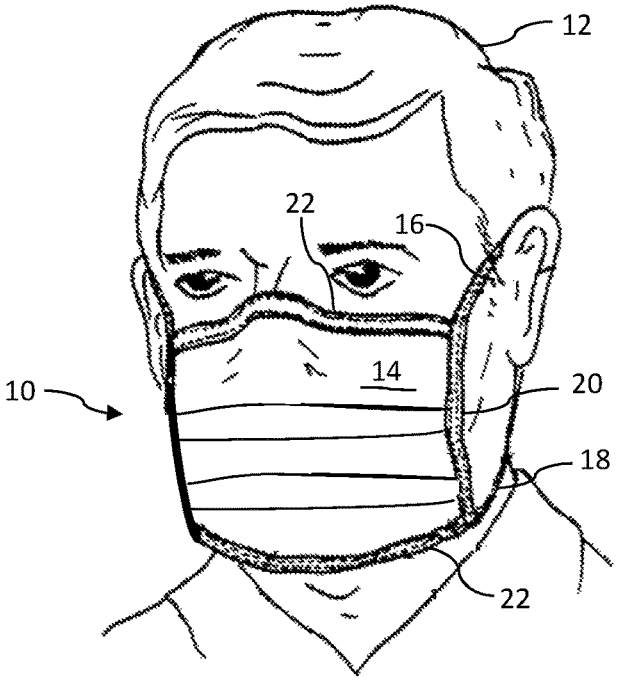
FIG. 1 is a perspective view of a conventional facemask worn by a user, the facemask incorporating upper and lower head fastening ties.

Referring to FIG. 1, a representative flat pleated facemask 10 is illustrated on the face of wearer 12. The mask 10 includes filter body 14 that is secured to the wearer 12 by means of a pair of upper ties straps 16 and a pair of lower tie straps 18. These tie straps may be defined by a continuous strip that is attached by known conventional means along the side edges 20 of the body 14. In alternate embodiments, the pairs of tie straps 16, 18 may be attached along the top and bottom edges 22 of the body, or may be defined by individual members attached to the corners of the body 14.

Figure 2:
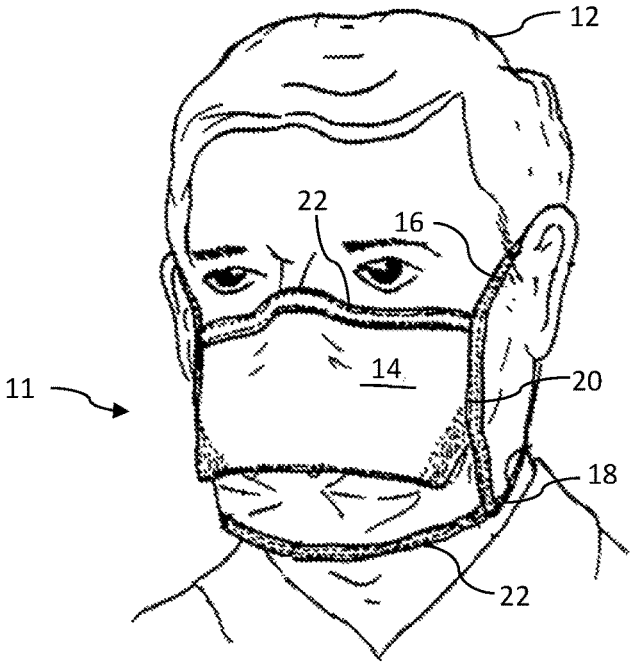
FIG. 2 is a perspective view of another conventional facemask worn by a user, the facemask incorporating upper and lower head fastening ties.

FIG. 2 depicts a duckbill style facemask 11 that has the general shape of a cup or cone when placed on the face of wearer 12 and thus provides "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing. With this style, the pairs of tie straps 16, 18 may be attached as described above with respect to the facemask 10 of FIG. 1.

Figure 3A:
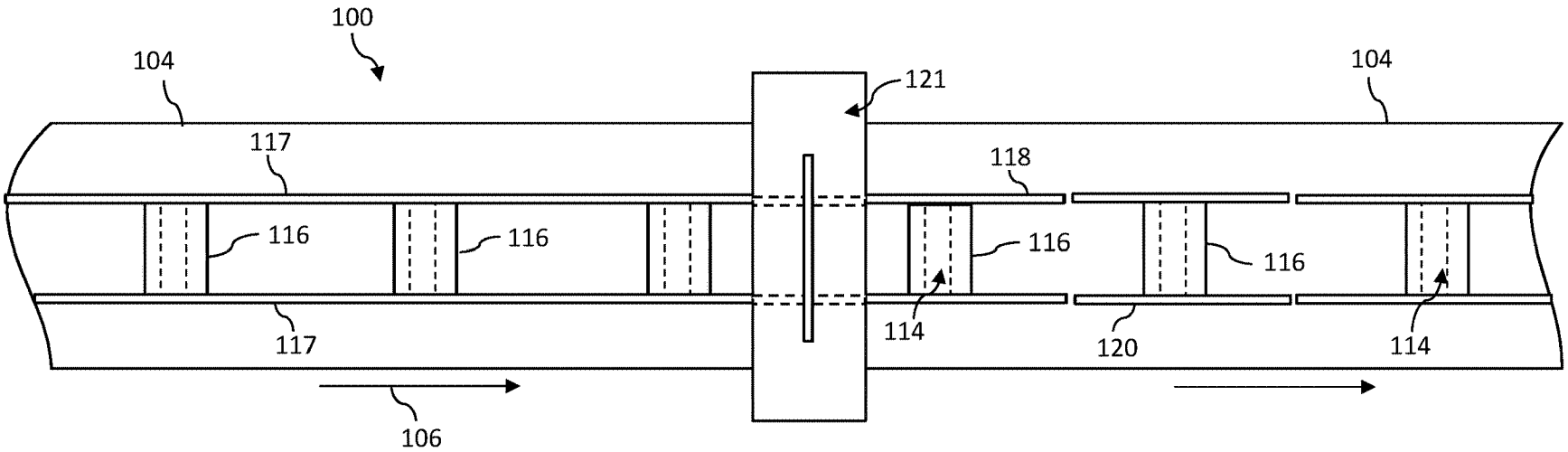
FIGS. 3*a* and 3*b* are top diagram views of portions of facemask production line incorporating aspects of the invention for cutting and wrapping leading and trailing ties around the body of the facemasks.

FIG. 3*a* depicts a portion of a facemask production line 100 wherein a plurality of facemask bodies 116 are moved on a conveyor 104 in a conveying direction 106. The bodies 116 are connected by a continuous tie strip 117 along each of the opposite sides of the bodies 116. This continuous tie strip 117 is applied to the sides of the bodies 116 in an upstream process. The strips 117 and bodies 116 are conveyed through a cutting station 121 wherein a blade or other cutting device severs the continuous ties strips 117 intermediate of the bodies 116. In this manner, each facemask 114 then includes a body 116 with a pair of leading ties 118 and a pair of trailing ties 120 relative to the conveying 106 of the facemasks 114. The length of the individual ties 118, 120 is a function of the spacing between the bodies 116 upstream of the cutting station 121.

Figure 3B:
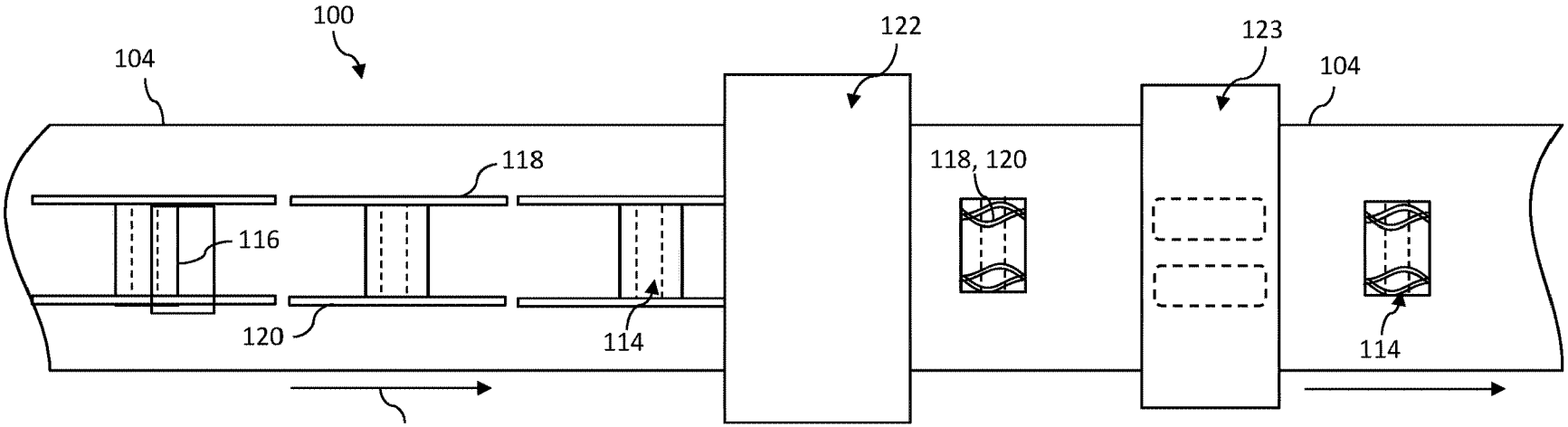
Figure 5A:
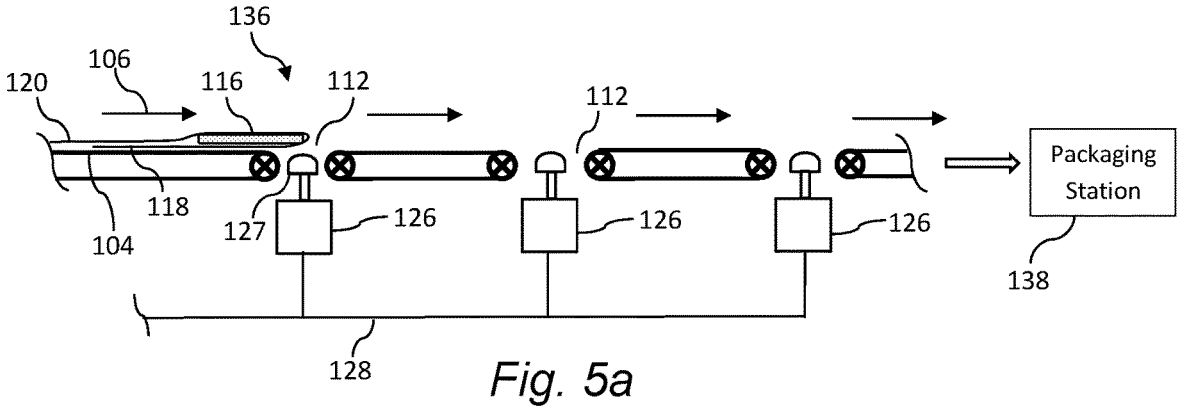
FIGS. 5*a* through 5*d* are sequential diagram views depicting flipping of the facemask body one or more times with a mechanical impingement device to wrap the leading and trailing ties around the body.
Figure 5B:
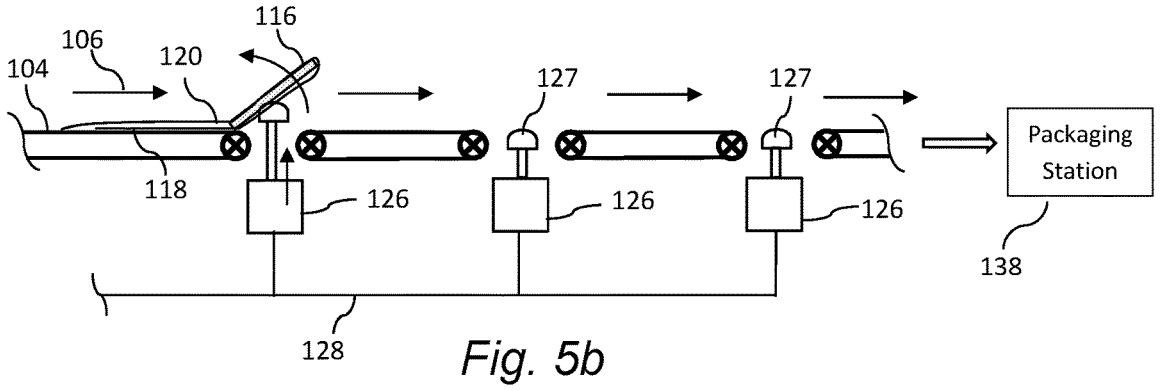
Figure 5C:
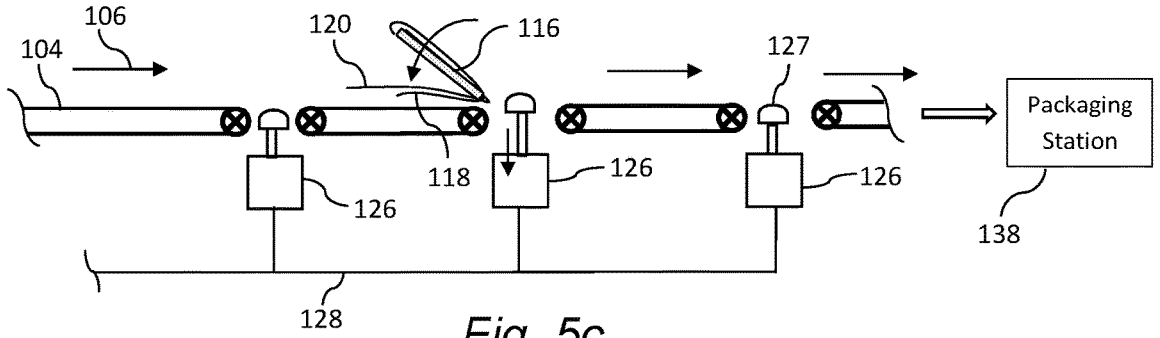
Figure 5D:
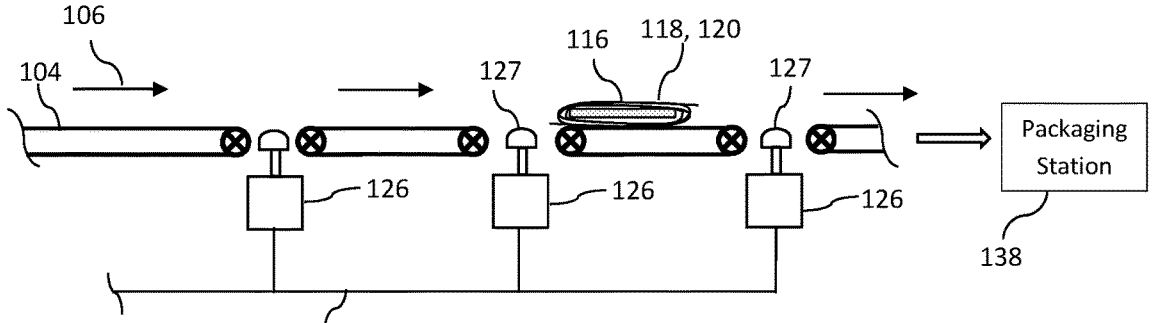

FIG. 3*b* depicts the facemasks 114 on the conveyor 104 downstream of the cutting station 121 of FIG. 3*a*. The individual facemasks 114, including the body 116 with leading ties 118 and trailing ties 120, are continuously conveyed in the conveying direction 106 to an automated wrapping station 122, as described in greater detail below. The facemasks 114 emerge from the wrapping station 122 with the pairs of leading 118 and pairs of trailing 120 ties wrapped one or more times around the body 116 adjacent to the sides of the body 116. From here, the facemasks 114 can be conveyed to a downstream packaging station 138 (FIGS. 5*a*-5*c*).

In an alternate conventional pleated facemask 114 embodiment, the tie straps 118, 120 are attached along the upper (nose) and lower (chin) edges of the facemask body 116, and thus have an initial horizontal orientation relative to the longer aspect of the body 116. The present method and system for wrapping the ties are applicable to these types of facemasks 114 as well. With this type of facemasks 114, the ties may be initially turned or oriented before the facemasks 114 reach the wrapping station 122 so that the ties have the same orientation relative to the body as the facemasks 114 and ties 118, 120 depicted in FIG. 3*b*. Alternatively, the ties 118, 120 need not be reoriented, but could be wrapped around the longer aspect of the body 116. It should thus be appreciated that the present methods and systems are not limited to any particular style or attachment of the ties 118, 120 relative to the facemask body 116.

FIG. 3*b* also depicts a setting station 123 downstream of the wrapping station 122 for the purpose of setting the folds in the wrapped ties 118, 120 to ensure that the ties do not prematurely unravel/unwrap during packaging and when removing and donning the facemasks 114. This may be done, for example, by passing the facemask 114 with wrapped ties between compression rollers or the nip of a compression conveyor configuration that induce creases or crimps in the folded ties 118, 120.

Figure 4A:
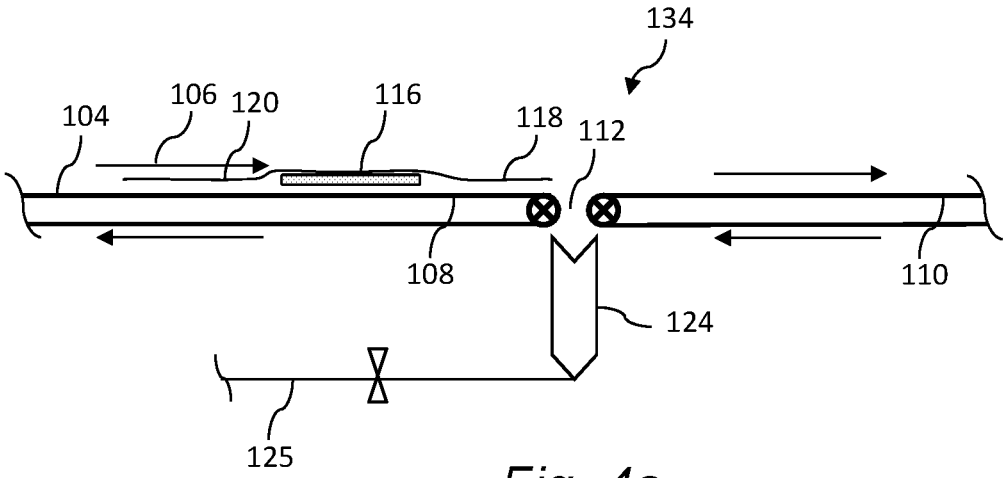
FIGS. 4*a* through 4*c* are sequential diagram views of the leading ties being drawn under the body of the facemask as the facemask continues to move in a conveying direction through the production line.
Figure 4B:
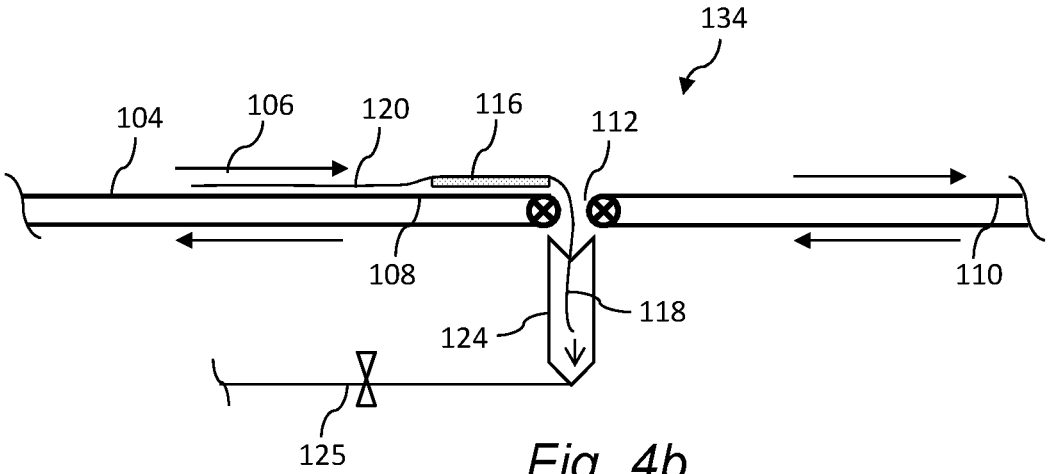
Figure 4C:
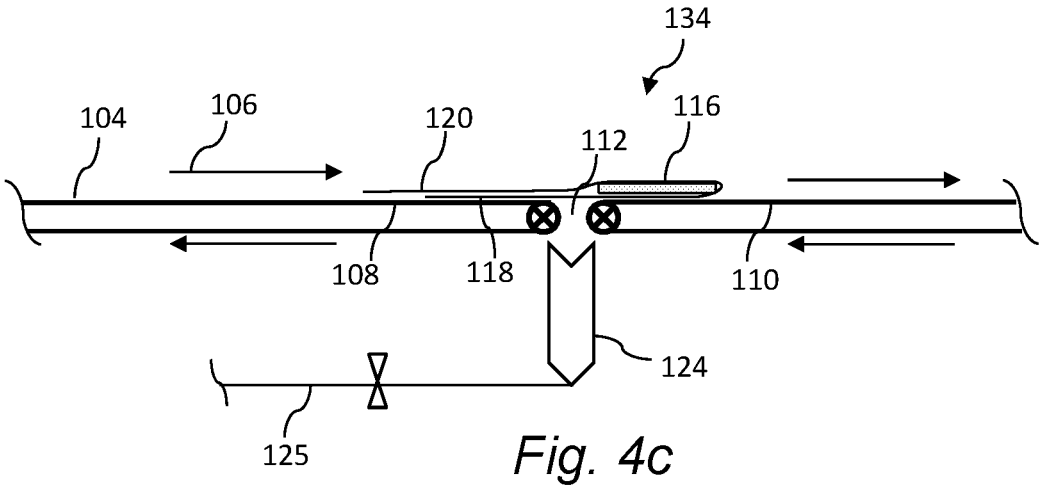

FIGS. 4*a* through 4*c* depict an embodiment of a means 134 at the wrapping station 122 (or upstream of the wrapping station) for initially drawing the pair of leading ties 118 below the facemask body 116 as the facemasks 114 continued to be conveyed in the conveying direction 106. The conveyor 104 includes a first section 108 and a second section 110, with a gap 112 defined between the sections 108, 110. A suction device 124 is disposed below the conveying plane of the conveyor 104 in the gap 112. A vacuum is drawn in the suction device 124 via a control/suction line 125. As depicted in the sequential figures, as the pair of leading ties 118 approaches the gap 112, they are drawn down into the suction device 124 as the body 116 continues to move across the gap 112 and onto the second section 110 of the conveyor 104. As the body 116 continues to move in the conveying direction 106, the pair of leading ties 118 are drawn out of the suction device 124 and are thus folded (partially wrapped) under the body 116, as depicted in FIG. 4*c*.

The suction device 124 may be controlled to drawn a generally continuous vacuum that is sufficient for drawing in the leading ties 118, yet allows for the ties 118 to be subsequently withdrawn as the body continues to move across the gap 112. In an alternate embodiment, the suction device may be controlled to only apply an intermittent vacuum to initially draw-in the leading ties 118, wherein the vacuum is released as the body 116 moves across the gap 112.

It should be appreciated that the means 134 for drawing the pair of leading ties 118 below the body 116 is not limited to the embodiment described above. An alternate embodiment may rely solely on gravity, wherein the pair of leading ties 118 drop into the gap 112. In an alternate embodiment, a mechanical device, such as a mechanical gripper or friction roller may be provided in the gap to engage the ties 118 as they drop into the gap 112.

The facemasks 114 with the pair of leading ties 118 folded under their body 116 are then conveyed through means 136 at the wrapping station 122 for directing an impinging force facemask body 116 that is sufficient to cause the body 116 to flip backwards at least once as the facemask 114 continues to be conveyed in the conveying direction 106. As the body 116 flips, the leading 118 and trailing 120 pairs of ties are caused to further wrap around the body 116. The impinging force may be applied a plurality of times to cause multiple flips of the body 116 and, thus, multiple wrappings of the leading 118 and trailing 120 pairs of ties around the body 116, depending on the length of the ties and the desired number of wraps.

It may be desired that the plurality of impinging force applications are carried out at sequentially spaced apart locations at the wrapping station 122 in the conveying direction, as depicted in FIGS. 5*a* through 5*d*. In this manner, the individual facemasks 114 are not stopped along the conveying direction to form the multiple wrappings. However, in other embodiments, the plurality of impinging force applications are can be carried out at the same location at the wrapping station 122. For example, a single station in the embodiment of FIGS. 5*a* through 5*d* (explained more fully below) may be used to flip the body 116 multiple times. When the body 116 is flipped backwards the first time, it again approaches the same impinging device and can be flipped one or more times by this same device in a "loop" operational sequence.

Referring to FIGS. 5*a* through 5*d*, the impinging means 136 is provided by one or more mechanical devices 126 disposed below the conveying plane of the conveyor 104 in respective gaps 112 in the conveyor 104. As seen in FIGS. 5*a* and 5*b*, when the leading edge of the body 116 moves into the gap 112, the mechanical device 126 is actuated via a control line 128 and a member 127, such as a cap, plate, roll, or the like, is directed upwards and hits an underside of the body 116 (between the areas on which the ties 118, 120 will wrap around the body 116) with sufficient force to cause the body 116 to flip backwards as the facemask 114 continues to be conveyed in the conveying direction. The member 127 is quickly withdrawn in order to allow the body 116 to subsequently pass over the gap 112. Once withdrawn, the member 127 may act as a bridge for the body to move onto the downstream section of the conveyor 104.

The mechanical device 126 may include a piston driven (e.g. hydraulic, pneumatic, spring driven, and the like) cap or plate member 127, as discussed above, that deploys from below the conveyor 104 and strikes the underside of the facemask body, or a rotary or eccentric driven member, and the like. As mentioned, any number of different suitable mechanical impinging devices within the scope and spirit of the invention may be used for this purpose. Timing of the mechanically actuated device 126 may be controlled by, for example, a sensor disposed at a location along the conveyor 104 to detect the leading edge of the facemask body 116 as the body reaches the gap 112. Timing may also be preset based on the spacing and conveying speed of the facemasks.

As can be appreciated from FIGS. 5*a* through 5*d*, multiple devices 126 can be disposed in multiple respective gaps 112 in the conveyor 104 for forming multiple wraps of the ties 118, 120. Depending on the actual length of the ties 118, 120, it may not be necessary to use all of the sequentially arranged devices 126.

Figure 6:
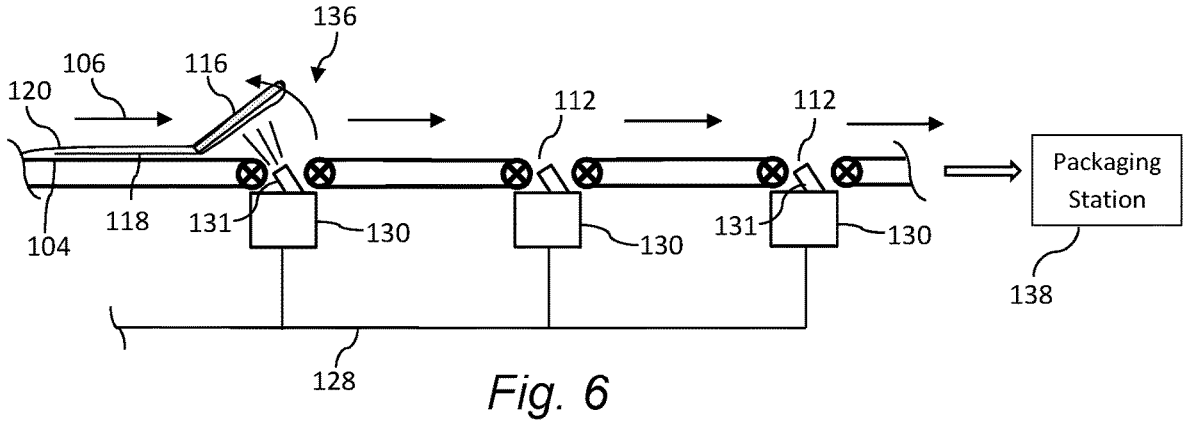
FIG. 6 is a diagram view depicting flipping of the facemask body one or more times with a pneumatic impingement device to wrap the leading and trailing ties around the body.

In still other embodiments, the impinging force means may be a pneumatic device, as depicted in FIG. 6. Such an embodiment is a "no touch" system in that mechanical contact need not be made with the body 116. A pneumatic device 131 controlled/supplied with high pressure air via a line 136 can direct bursts of high pressure air from one or more nozzles 131 to impact an underside of the body 116 with sufficient force to cause the body 116 to flip backwards as the facemask 114 continues to be conveyed in the conveying direction 106. For example, the pneumatic device 131 may dispose the nozzle 131 below the conveying plane in a gap 112 in the conveyor 104. As the facemask body 116 passes over the gap 112, a high pressure air burst from the nozzle 131 impinges on the underside of the body 116 and causes the facemask 114 to flip backwards, thereby wrapping the ties 118, 120 around the body 116.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. An automated method for wrapping fastening ties around a body of a continuous stream of facemasks in a facemask production line, comprising:

conveying the facemasks on a conveyor in the production line at an orientation such that each facemask has a leading pair of ties and a trailing pair of ties extending from a body in a conveying direction of the production line;

at or upstream of a wrapping station in the production line, drawing the leading pair of ties below the body as the facemask continues to be conveyed in the conveying direction such that the leading pair of ties wraps under the body;

at the wrapping station, subsequently directing an impinging force to the body, the impinging force being sufficient to cause the body to flip backwards at least once as the facemask continues to be conveyed in the conveying direction, thereby causing the leading and trailing pairs of ties to further wrap around the body.

2. The automated method of claim 1, wherein the leading pair of ties is drawn below the body by a suction device disposed below the conveyor.

3. The automated method of claim 2, wherein the suction device is disposed in a gap between a first section of the conveyor and a second section of the conveyor, the facemasks moving onto the second section of the conveyor and drawing the leading pair of ties out of the suction device to cause the leading pair of ties to wrap under the body.

4. The automated method of claim 1, wherein the impinging force is applied a plurality of times to the body to cause multiple flips of the body and multiple wrappings of the leading and trailing pairs of ties around the body.

5. The automated method of claim 4, wherein the plurality of impinging force applications are carried out at sequentially spaced apart locations at the wrapping station in the conveying direction.

6. The automated method of claim 4, wherein the plurality of impinging force applications are carried out at the same location at the wrapping station.

7. The automated method of claim 1, wherein the impinging force is applied by a mechanical device that hits an underside of the body with sufficient force to cause the body to flip backwards as the facemask continues to be conveyed in the conveying direction.

8. The automated method of claim 7, wherein the mechanical device deploys from below through a gap in the conveyor on which the facemasks are conveyed through the wrapping station.

9. The automated method of claim 1, wherein the impinging force is applied by a pneumatic device that directs high pressure air to impact an underside of the body with sufficient force to cause the body to flip backwards as the facemask continues to be conveyed in the conveying direction.

10. The automated method of claim 9, wherein the pneumatic device directs the high pressure air from below through a gap in a conveyor on which the facemasks are conveyed through the wrapping station.

11. An automated production line system for wrapping fastening ties around a body of a continuous stream of facemasks conveyed through the production line, comprising:

a conveyor on which the facemasks are conveyed at an orientation such that each facemask has a leading pair of ties and a trailing pair of ties extending from a body in a conveying direction of the production line;

a wrapping station location in the production line;

at the wrapping station, means for drawing the leading pair of ties below the body as the facemask continues to be conveyed in the conveying direction such that the leading pair of ties wraps under the body; and means for subsequently directing an impinging force to the body, the impinging force being sufficient to cause the body to flip backwards at least once as the facemask continues to be conveyed in the conveying direction, thereby causing the leading and trailing pairs of ties to further wrap around the body.

12. The automated production line system of claim 11, wherein the means for drawing the leading pair of ties comprises a suction device disposed below the conveyor on which the facemasks are conveyed to the wrapping station.

13. The automated production line system of claim 12, wherein the suction device is disposed in a gap between a first section of the conveyor and a second section of the conveyor, the facemasks moving onto the second section of the conveyor and drawing the leading pair of ties out of the suction device to cause the leading pair of ties to wrap under the body.

14. The automated production line system of claim 11, wherein the means for directing the impinging force actuates a plurality of times to cause multiple flips of the body and multiple wrappings of the leading and trailing pairs of ties around the body.

15. The automated production line system of claim 14, wherein the plurality of actuations are carried out at sequentially spaced apart locations at the wrapping station in the conveying direction.

16. The automated production line system of claim 14, wherein the plurality of actuations are carried out at a same location at the wrapping station.

17. The automated production line system of claim 11, wherein the means for directing the impinging force comprises a mechanical device disposed to hit an underside of the body with sufficient force to cause the body to flip backwards as the facemask continues to be conveyed in the conveying direction.

18. The automated production line system of claim 17, wherein the mechanical device is disposed to deploy from below through a gap in the conveyor.

19. The automated production line system of claim 11, wherein the means for directing the impinging force comprises a pneumatic device disposed to direct high pressure air to impact an underside of the body with sufficient force to cause the body to flip backwards as the facemask continues to be conveyed in the conveying direction.

20. The automated production line system of claim 19, wherein the pneumatic device is disposed to direct the high pressure air from below through a gap in the conveyor.

* * * * *